US012383815B2

(12) United States Patent
Burke et al.

(10) Patent No.: US 12,383,815 B2
(45) Date of Patent: Aug. 12, 2025

(54) STEAL THE BACON BOARD GAME

(71) Applicants: Stevie Amos Burke, Wilmington, NC (US); Alayne Mahoney, Wilmington, NC (US)

(72) Inventors: Stevie Amos Burke, Wilmington, NC (US); Alayne Mahoney, Wilmington, NC (US)

( * ) Notice: Subject to any disclaimer, the term of this patent is extended or adjusted under 35 U.S.C. 154(b) by 0 days.

(21) Appl. No.: 16/898,408

(22) Filed: Jun. 10, 2020

(65) Prior Publication Data

US 2021/0387082 A1 Dec. 16, 2021

(51) Int. Cl.
*A63F 3/00* (2006.01)

(52) U.S. Cl.
CPC ..... *A63F 3/00082* (2013.01); *A63F 3/00006* (2013.01); *A63F 2003/00015* (2013.01)

(58) Field of Classification Search
CPC ..... A63F 3/00006; A63F 3/00082; A63F 2003/00015; A63F 2003/00025
See application file for complete search history.

(56) References Cited

U.S. PATENT DOCUMENTS 2,163,011 A * 6/1939 Schaub ..... A63F 3/0494 273/252
3,223,420 A * 12/1965 Turner ..... A63F 3/00091 273/148 A
4,030,762 A * 6/1977 Gilmore ..... A63F 3/00006 273/248
8,104,768 B2 * 1/2012 Al-Buijan ..... A63F 3/00006 273/242

OTHER PUBLICATIONS

Leslie Williams, "Steal the Bacon Verb Edition", www.teacherspayteachers.com/Product/Steal-the-Bacon-Verb-Edition-1012945, publicly available since 2014 as evidenced by user reviews posted on Sep. 25, 2014 (Year: 2014).*

* cited by examiner

*Primary Examiner* — Laura Davison
(74) *Attorney, Agent, or Firm* — Ashley D. Johnson; Dogwood Patent and Trademark Law

(57) ABSTRACT

The present invention relates to a traditional board game, Steal the Bacon activity and the integration of both elements. The traditional game has two lines of players facing each other and when "their" assigned number is called, they run to steal the bacon and bring it home. To replicate the traditional game into a board game; we designed Ref cards which are used in leu of a live referee calling out numbers. To simulate 2 people running to "steal the bacon" and bring it home, we had each player roll a different color die at the same exact time. The player with the largest number rolled moved the number of spaces rolled on his/her dice. This pattern repeats (rolling the dice) until a player "steals the bacon" and tried bringing it back to home.

7 Claims, 3 Drawing Sheets

Team Steal the Bacon

STEAL THE BACON BOARD GAME

BACKGROUND

Prior art for "Steal the Bacon" board and game is slim to none. Steal the bacon is a tag-based traditional children's game, in which teams try to steal a flag or other items from the field without being tagged.

SUMMARY OF INVENTION

The fore mentioned invention is a transformation of an activity combined with a board game whereby we have designed different ways of collectively playing both at once.

DESCRIPTION OF DRAWINGS

The 4 drawings incorporated herein form part of the specifications and illustrate the diverse embodiments of the present disclosure. Together with the descriptions, they explain the principles and concept of the boardgame Steal the Bacon.

DETAILED DESCRIPTION

Figure 1:
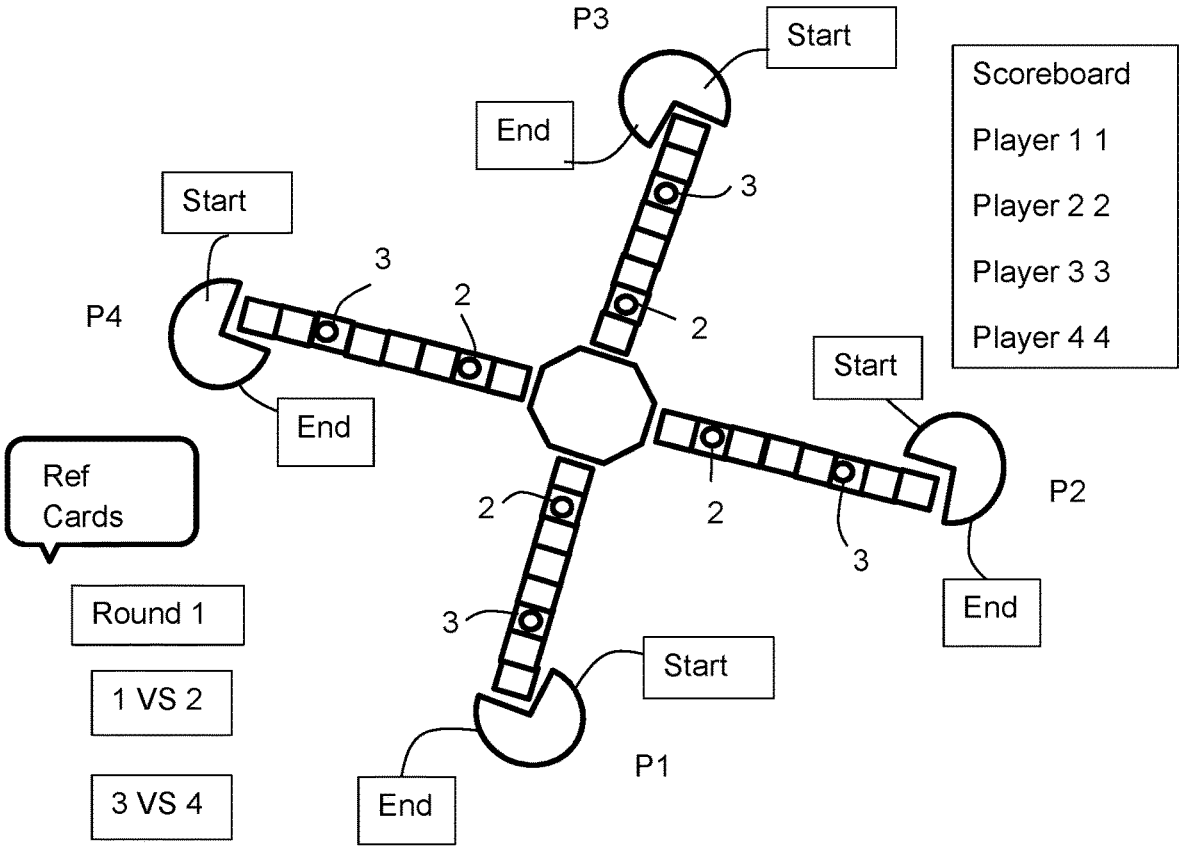
FIG. 1 is a drawing of the Solo version of Steal the Bacon boardgame as descripted in part one of the description section, including a scoreboard, a Start/end sector, and the round placement.
Figure 2:
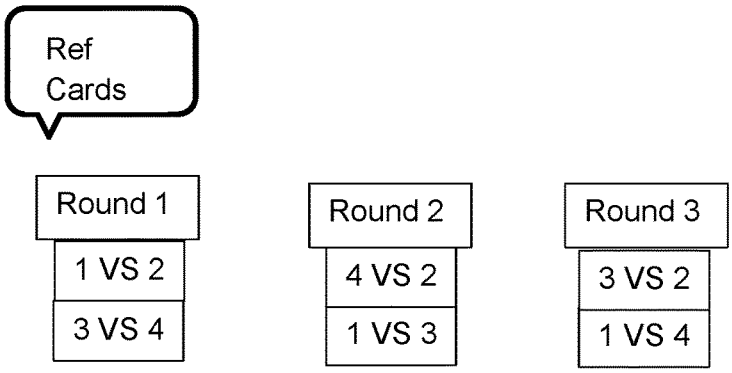
FIG. 2 is a drawing of the Ref cards on solo.
Figure 3:
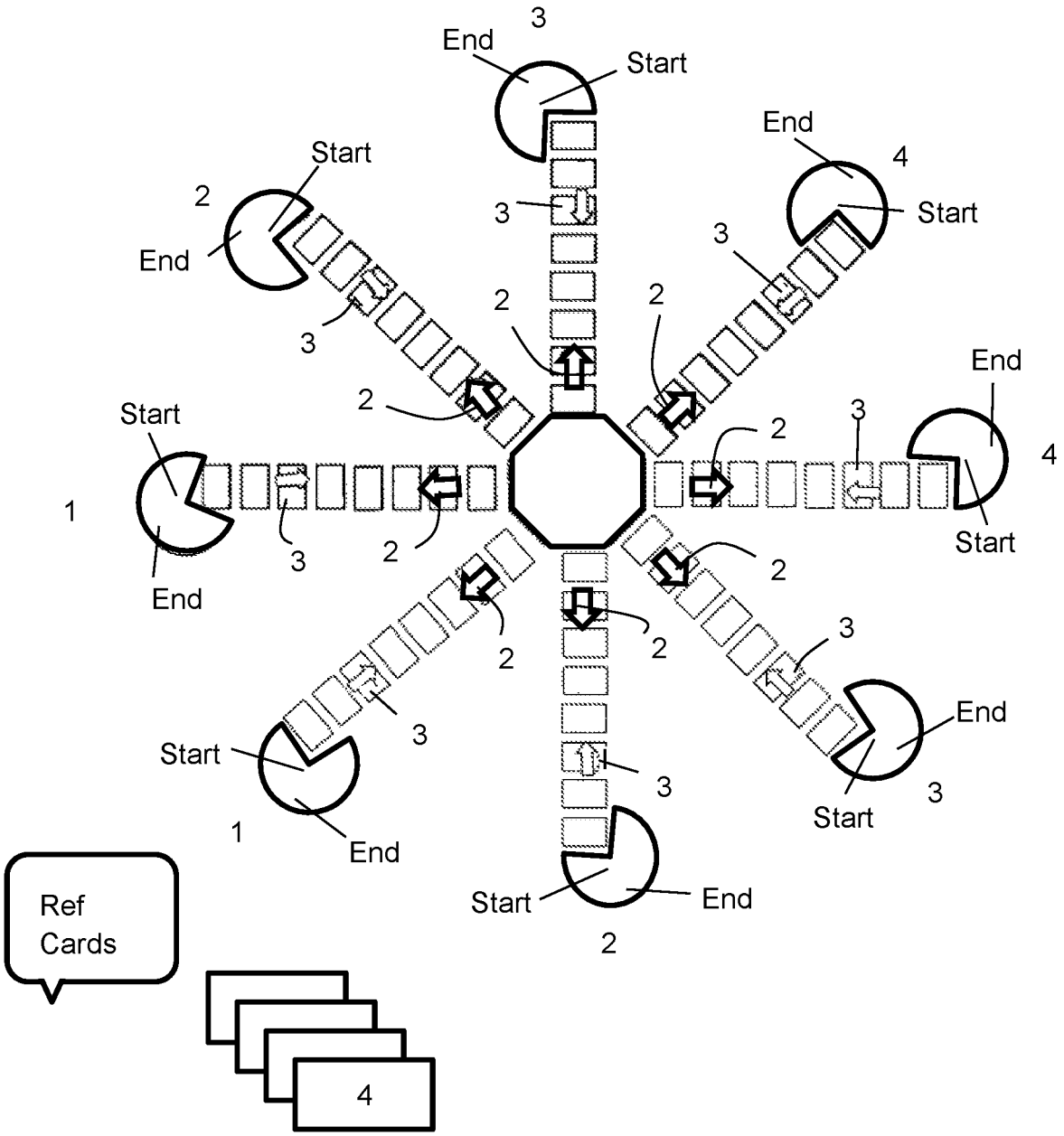
FIG. 3 is a drawing of team Steal the Bacon boardgame.
Figure 4:
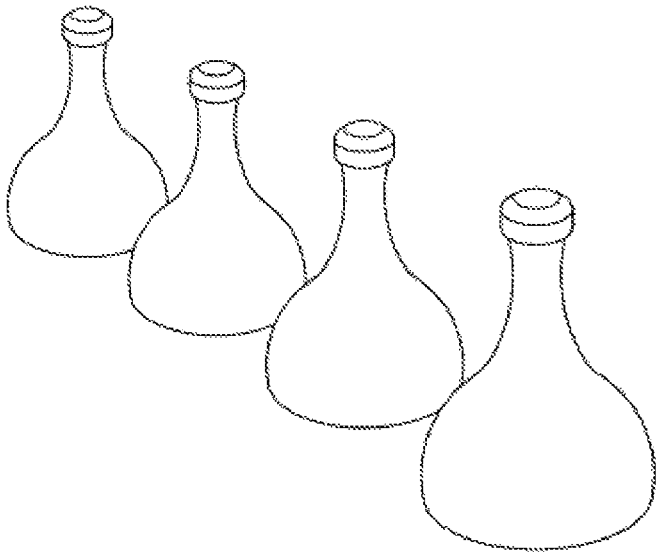
FIG. 4 is a drawing of the pawns.

Part 1/game conversion and Solo steal the Bacon: The concept for the game originated from playing the traditional street game as a child. The traditional game has two lines of players facing each other and when "their" assigned number is called, they run to steal the bacon and bring it home. To replicate the traditional game into a board game; we designed Ref cards which are used in leu of a live referee calling out numbers. Each card has two numbers ranging from 1 to 4 in this format numbers 1 and 2 are on one card. For example, when a Ref card indicating 1 and 2 is drawn; player 1 and 2 move to "steal the bacon" and or "Return Home". To simulate 2 people running to "steal the bacon" and bring it home, we had each player roll a different color die at the same exact time. The player with the largest number rolled moved the number of spaces rolled on his/her dice (The numbered rolled equates to the number of spots a player(s) can move on the board). When that player was done, the other player moved the number of spaces on his/her die. This pattern repeats (rolling the dice) until a player "steals the bacon" and tried bringing it back to home. If the player makes it back to their Start/Home un-tagged, that player gets one point. The runner up/player keeps on rolling to try to stop their opponent from bringing the bacon home by tagging their opponent. A "tag" is accomplished when the chasing player is one square behind and or passes the player who "stole the bacon". After the two ref cards have been discarded another round started. Once the third round is complete, the cards are then reshuffled and placed back to continue the game until a player gets 3 points to win.

To make the game somewhat more challenging, marked boxes have been added to the board which simulates moving forward 3 "running faster" or move backwards 2 "running slow". For example, if a player lands on a marked box, they must either move forward 3 spots or move back 2 spots accordingly.

Two ref cards are flipped each round, they must be reshuffled to begin another round. The first player to steal 3 bacon's WINS.

The board was designed with 8 spaces on each path to guarantee a minimum of 2 rolls to "steal the bacon"; and again to "return home". Since the bacon is the focus of the game, we placed the bacon in the center. We choose an octagon shape as it has 8 sides and it gave us the option to accommodate up to 8 players.

Object of the Game:

Be the first to get 3 points.

How to Play:

Solo Steal the Bacon.

First shuffle Ref cards. Call out the numbers indicated on the Ref card in R1 and place the Ref card in the discard pile. Players selected on the ref card roll their dice simultaneously.

The opponent who rolled the highest number on their dice moves first.

The first player moves the number of spaces matching rolled amount toward the octagon to "steal the bacon" or back to "return home".

Then the next player moves their pawn the number spaces rolled.

If you land on a forward arrow 3; move your pawn 3 spaces in the direction of the arrow. If you land on a back arrow 2; move your pawn 2 spaces in the direction of the arrow. The first player to reach the octagon "steals the bacon" and must turn around and take it back home without getting tagged.

When the player who "stole the bacon" returns home without getting tagged; they receive 1 point for that round.

The trailing player "chases" the player who "stole the bacon" to try to tag them. A "TAG" happens when the trailing player is one spot behind the player who "stole the bacon" or rolls a higher number to pass the player with the bacon.

If a player is tagged, no points will be awarded and both players return to their Home/Start. Flip remaining card and repeat the same steps and Continue playing until a winner is crowned.

Team Steal the Bacon—Eight (8) Player, Team Game.

Object of the Game:

Be the first team to get 7 points

How to Play:

Team Steal the Bacon.

Shuffle Ref Cards and select Top card.

Call out the number indicated on the Ref card and place the Ref card in the discard pile.

The team players selected on the ref card roll their dice simultaneously.

The opponent who rolled the highest number on their dice moves first, if both players roll the same number then both move simultaneously.

The first player moves the number of spaces matching rolled amount toward the octagon to "steal the bacon" or back to "return home".

Then the player with the lower number rolled moves their pawn the number of spaces rolled.

If you land on a forward arrow 3; move your pawn 3 spaces in the direction of the arrow.

If you land on a back arrow 2; move your pawn 2 spaces in the direction of the arrow.

The first player to reach the octagon "steals the bacon" and must turn around and take it back home without getting tagged.

When the player who "stole the bacon" returns home without getting tagged; their team receives 1 point. The trailing player "chases" the player who "stole the bacon" to try to tag them. A "TAG" happens when the trailing player is one spot behind the player who "stole the bacon" or rolls a higher number to pass the player with the bacon. If a player is tagged, no points will be awarded and both players return to their home/start. Repeat until all ref cards have been discarded then reshuffle the deck and repeat this process so a winner can be crowned.

What is claimed is:

1. A method of playing a game for four players, the method defined by:

assigning each player a number from 1 to 4;

assigning each player a pawn positioned on one of four game board homes of a game board and assigning each player to the game board home on which that player's pawn is positioned, the game board defined by a central octagon and the four game board homes, wherein each home connects to the central octagon by a set of spaces, wherein one of the spaces comprises a "running faster" box and one of the spaces comprises a "running slow" box for each set of spaces;

shuffling a set of ref cards, the ref cards defined as a set of cards, each card comprising two numbers ranging from 1 to 4, wherein each number corresponds to a player number;

selecting a ref card, wherein the numbers on the ref card identify two of the players;

wherein the two players selected on the ref card roll dice simultaneously, and the player that rolls a highest number moves the corresponding assigned pawn the number of spaces rolled by that player's die in a direction towards the central octagon and back to that player's home;

repeating the moving by the player that rolled a second highest number;

shuffling the set of ref cards and repeating the selecting step the dice-rolling step, and the moving step by the player that rolls a highest number and the player that rolls a second highest number in the dice-rolling step;

wherein when one of the players moves from that player's home to the central octagon and back to that player's home without getting tagged, that player wins one point;

wherein a tag occurs when one of the players, as a trailing player, is one space behind or passes a second one of the players that has reached the central octagon and is heading back to the second player's home and when the tag occurs, both players return to their homes with no points awarded;

wherein when one of the players wins three points, that player is declared the winner of the game.

2. The method of claim 1, wherein the running faster box moves a pawn forward three spaces when landed upon, and the running slower box that moves a pawn backward two spaces.

3. The method of claim 1, wherein each player is assigned a unique colored die.

4. The method of claim 1, wherein each home connects to the central octagon by 8 spaces.

5. A method of playing a team game for two teams of four players each, the method defined by:

assigning each player from each team a number from 1 to 4;

assigning each player from each team a pawn positioned on one of eight game board homes of a game board, the game board defined by a central octagon and the 8 game board homes, wherein each home connects to the central octagon by a set of spaces, wherein one of the spaces comprises a "running faster" box and one of the spaces comprises a "running slow" box for each set of spaces;

shuffling a set of ref cards, the ref cards defined as a set of cards, each card comprising one number ranging from 1 to 4, wherein each number corresponds to a player number;

selecting a ref card, wherein the number on the ref card identifies a player from each team associated with that number;

wherein the players selected on the ref card roll dice simultaneously, and the player that rolls a highest number moves the corresponding assigned pawn the number of spaces rolled by that player's die in a direction towards the central octagon and back to that player's home;

repeating the moving by the player that rolled a second highest number;

shuffling the set of ref cards and repeating the selecting step the dice-rolling step, and the moving step by the player that rolls a highest number and the player that rolls a second highest number in the dice-rolling step;

wherein when one of the players moves from that player's home to the central octagon and back to that player's home, that player's team wins one point;

wherein when one of the teams wins seven points, that team is declared the winner of the game.

6. The method of claim 5, wherein the running faster box moves a pawn forward three spaces when landed upon, and the running slower box moves a pawn backward two spaces.

7. The method of claim 5, wherein each home connects to the central octagon by 8 spaces.

* * * * *